United States Patent [19]

Wiesmann et al.

[11] Patent Number: 4,509,793

[45] Date of Patent: Apr. 9, 1985

[54] CHAIR

[75] Inventors: Herbert L. Wiesmann, Hameln; Heinz P. Suhr, Wunstorf, both of Fed. Rep. of Germany

[73] Assignee: Wilkhahn Wilening + Hahne GmbH + Co., Fed. Rep. of Germany

[21] Appl. No.: 495,077

[22] Filed: May 16, 1983

[30] Foreign Application Priority Data

Sep. 3, 1982 [DE] Fed. Rep. of Germany ..... 3232771

[51] Int. Cl.[3] ..... A47G 1/00

[52] U.S. Cl. ..... 297/355; 297/300; 297/316; 297/344

[58] Field of Search ..... 297/355, 344, 331, 332, 297/270, 300, 285, 83, 88

[56] References Cited

U.S. PATENT DOCUMENTS

| | | | |
|---|---|---|---|
| 4,200,332 | 4/1980 | Brauning | 297/300 |
| 4,270,797 | 6/1981 | Brauning | 297/316 X |
| 4,408,800 | 10/1983 | Knapp | 297/285 |
| 4,432,582 | 2/1984 | Wiesmann et al. | 297/300 X |
| 4,451,085 | 5/1984 | Franck et al. | 297/457 X |

*Primary Examiner*—Kenneth Downey
*Attorney, Agent, or Firm*—Antonelli, Terry & Wands

[57] ABSTRACT

An office chair including a seat portion, a backrest portion joined to the seat portion in an articulated or flexible fashion, and an underframe. The seat portion is articulatingly supported, in an area of a forward edge thereof, on a front bearing pipe and the backrest portion is supported approximately at a hip level through supporting levers on a horizontally extending supporting shaft disposed below the seat portion at a distance therefrom so that solely by shifting one's weight, the inclination of the backrest portion and seat portion can be varied. A locking mechanism, which may be conveniently manipulated from a sitting position and which does not impair the overall appearance of the chair is provided which includes a locking lever disposed in a space between the bearing pipe and the supporting shaft in a housing section of the underframe. The locking mechanism is operable by way of a transmission path from an operating lever arranged in close proximity below the forward edge of the seat portion.

24 Claims, 9 Drawing Figures

CHAIR

The present invention relates to a furniture construction and, more particularly, to an office chair which includes a seat portion, a backrest portion joined to the seat portion in an articulated or flexible fashion, a spring means for stressing the backrest portion toward an upright or steep position, and an underframe, with the underframe including a horizontally extending front bearing pipe means for supporting the seat portion in an articulated manner at a forward edge area thereof and a rear horizontal bearing pipe spaced beneath the seat portion, and with at least one supporting member for supporting the back in an articulated fashion approximately at a hip level and being rigidly connected to a horizontal supporting shaft provided with at least one radially projecting cam.

Office chairs of the aforementioned type have been proposed, for example, Offenlegungsschrift No. 3,036,993 and commonly assigned co-pending U.S. Application Ser. No. 244,679 wherein an inclination of a seat portion and angle of the backrest portion are automatically varied within a predetermined relationship with respect to each other by shifting ones weight in the chair between a steep or vertical seat portion position and a comfortable rearwardly inclined position.

Generally, in, for example, office chair construction, it is desireable to be able to lock the backrest portion of the chair in a steep upright or vertical seating position. For this purpose, locking mechanisms have been proposed which are equipped with a so-called pneumatic spring; however, pneumatic springs represent a relatively trouble-prone component which cannot readily be replaced by the user of the chair in case of, for example, damage or malfunction.

Additionally, purely mechanical locking mechanisms have been proposed wherein a pin-shaped catch member is introduced into a corresponding catch opening; however, such proposals require inconvenient manipulation especially since the operating member may only be seized and manipulated in a sitting position only with bodily contortion. Moreover, such proposed locking mechanisms are often bulky so that they impair the overall esthetics of the chair.

Additionally, in, for example, Offenlegungsschrift No. 2,332,596, a so-called synchronous seat and back adjustment chair is proposed wherein rearward seat edges are articulated directly or by way of a low bearing block to an adjoining back portion.

It has also been proposed in, for example, German Utility Models Nos. 7,721,954 and 7,815,561 to subdivide the surface of the seating portion into a forward partial surface and a rearward partial surface hingedly joined to the forward partial surface. While in these proposed constructions three body supporting surfaces, that is, the forward partial surface, rearward partial surface and back portion, are variable in their inclination, in these constructions, the adaptation to the respective body attitude can only be achieved by considerably increasing the overall constructional costs.

The aim underlying the present invention essentially resides in providing a furniture construction such as, for example, an office chair, which includes a locking mechanism for enabling a locking of a seat portion and/or backrest portion inclination, which locking mechanism is provided with operating means which may be conveniently siezed and manipulated while sitting and which is also arranged in a hidden fashion within a mechanical system of the chair and thereby avoiding any interference with the overall appearance of the chair.

In accordance with advantageous features of the present invention, a chair such as, for example, an office chair is provided which includes a locking mechanism having a locking lever articulated to an underframe of baseframe of the chair, with the locking lever being articulated by means of a force transmission member, to an operating sleeve penetrating through a front bearing pipe and being rotatable by an operating lever, with the locking lever being adapted to be pivioted or swung into a path of motion of a cam as a catch means.

By virtue of the above noted features of the present invention, it is possible to provide an office chair construction wherein the operating member for the locking mechanism is arranged beneath a surface of the seat portion and, in particular, in close proximity to a forward edge thereof as well as in close proximity to one of the lateral edges thereof so that the operating member may be conveniently reached, for example, with the left hand, while the seat is in an upright position as well as in a rearwardly inclined position.

The force transmission may, in accordance with the present invention, take place by means of the operating sleeve which surrounds a front bearing pipe, which front bearing pipe is generally included in office chair constructions. Consequently, it is hardly if at all optically percieved.

Moreover, by virtue of the present invention, it is possible for a force transmission to take place by way of a transmission member which, as in the case of the locking lever, may be constructed of a relatively small dimension so that parts may be arranged in more or less hidden fashion within a section of the underframe carrying the front bearing pipe and the rearward supporting shaft.

Advantageously, the locking mechanism constructed in accordance with the present invention may be utilized in an office chair wherein the supporting shaft is provided with two cams projecting in parallel in a downward direction, with each cam being articulated to a bifurcated spherical joint of a control rod surrounded by a helical compression spring.

With an office chair constructed in the manner described hereinabove, the provision may be made in accordance with the present invention that the locking lever is supported centrally between the two helical compression springs on a boxed-shaped housing section of the underframe and carries two locking arms, each of the arms being aligned to stop members provided at the two bifurcated spherical joints. Advantageously, the locking arms encompass between them a supporting device of the housing section on the base side thereby permitting an especially compact and completely hidden location of the locking mechanism while simultaneously being able to ensure a symmetrical force distribution.

In accordance with still further features of the present invention, the bearing pipe is provided with a slotted hole or opening which extends in a peripheral direction for enabling a penetration of a pin radially projecting from an operating sleeve, with the force transmission member being articulated to the pin.

Advantageously, the force transmission member is constructed as a stiff wire; however, it is also possible for the force transmission member to be constructed as a Bowden cable or the like.

In accordance with still further features of the present invention, a detent is provided for controlling a position of the pin accommodated in the slotted hole or opening, with the detent means being fashioned as a leaf spring bent approximately into a hairpin-shaped configuration. The pin is adapted to be pivotable within the leaf spring, with a rear leg of the leaf spring being attached to the box-shaped housing section, and the spring exhibiting or forming a detent stop lying between the two end pivot positions of the pin.

The supporting shaft of the chair of the present invention includes two parallel downwardly projecting cams, with each of the cams being articulated to a bifurcated spherical member of a control rod surrounded by a helical compression spring, with the two bifurcated spherical members being rigidly connected to a bridge for enabling a circumventing of the supporting means of the chair on the base side.

Accordingly, it is an object of the present invention to provide an article of sitting furniture which avoids, by simple means, shortcomings and disadvantages encountered in the prior art.

Another object of the present invention resides in providing an article of sitting furniture such as, for example, an office chair, which is simple in construction and therefore relatively inexpensive to manufacture.

Yet another object of the present invention resides in providing an office chair construction which includes a locking mechanism for locking a seat portion and/or backrest portion at a specific inclination, which locking mechanism is easily accessible while in a sitting position and which is yet hidden within the mechanical system of the chair.

A further object of the present invention resides in providing an office chair construction which includes a locking mechanism arranged in such a manner so as to not interfer with the esthetic appearance of the chair.

These and other objects, features, and advantages of the present invention will become more apparent from the following description when taken in connection with the accompanying drawings which show, for the purposes of illustration only, several embodiments in accordance with the present invention, and wherein.

Figure 2:
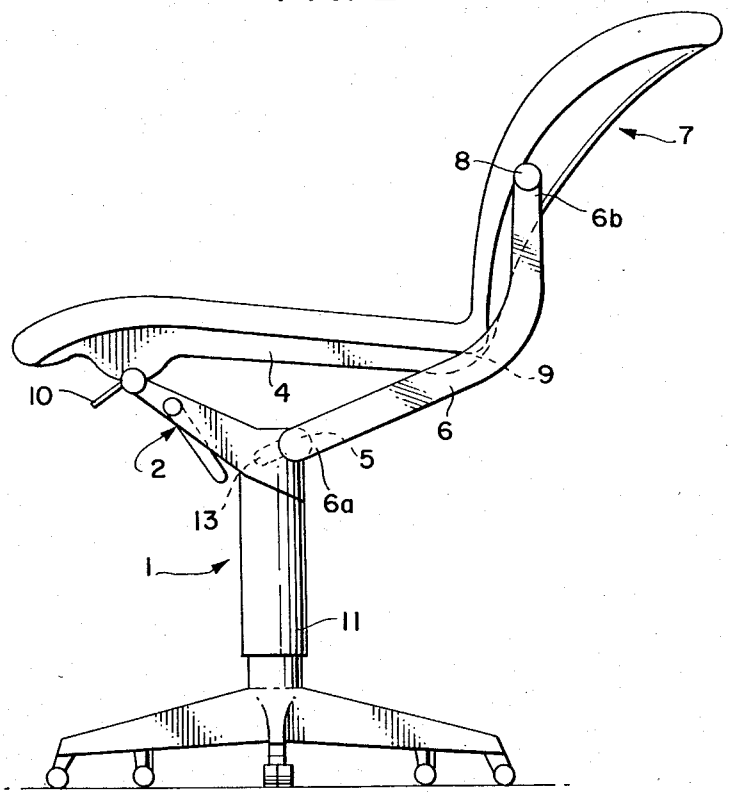
FIG. 2 is a side view of the office chair of FIG. 1 in a rearwardly pivoted rest position.
Figure 1:
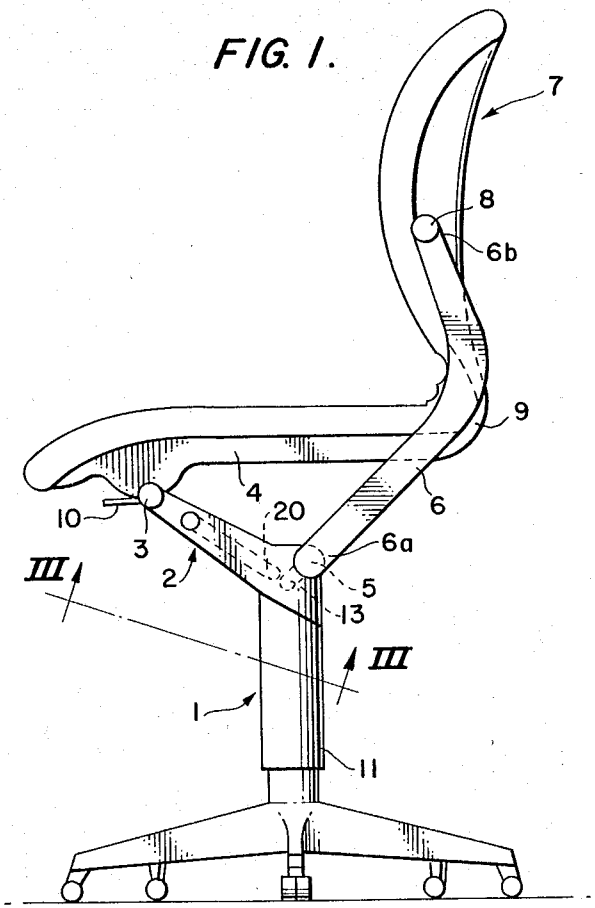
FIG. 1 is a side view of a piece of sitting furniture constructed in accordance with the present invention, fashioned as an office chair, in a vertical or basic position.

Referring now to the drawings wherein like reference numerals are used throughout the various views to designate like parts and, more particularly, in FIGS. 1 and 2, according to these Figures, an article of sitting furniture such as, for example, a so-called office chair, includes an underframe generally designated by the reference numeral 1 fashioned of a column or tubular support 11 and a supporting arm generally designated by the reference numeral 2 constructed in the form of a flat broad housing section projecting from the upper end of the column or tubular support 11 and lying approximately below or beneath a center of a seat portion 4 in a forward direction. The flat box-like housing section forming the supporting arm 2 carries, at a front end thereof, a horizontal front bearing pipe 3 to which the seat portion 4 is articulated in a forward zone thereof. A supporting shaft 5 is rotatably mounted to an upper end of the column 11 or rotatably mounted to a rear end of the flat box-shaped housing section forming the supporting arm 2 at a predetermined distance or spacing beneath the seat portion 4. A supporting lever 6 is rigidly attached to the respective ends **6*a* of the supporting shaft 5, with opposite ends 6*b* of the supporting lever 6 being articulated to a backrest portion generally designated by the reference numeral 7 of the chair approximately at a hip level point 8. The seat portion 4 and backrest portion 7 are formed of a one piece synthetic resin shell joined with each other in an articulated or flexible fashion by a central or intermediate connecting section 9** having an almost planar cross section.

A manual operating lever is disposed, for example, in a region of a forward left-hand corner and beneath the seat portion 4. The manual operating lever 10 is, as shown most clearly in FIG. 3, attached to an operating sleeve 16 extending out of the bearing pipe 3 and is adapted to operate the locking mechanism in a manner more fully described hereinbelow to lock the chair and/or backrest portion 7 in the vertical or upright position illustrated in FIG. 1. With the manual operating lever 10 being displaced to upward position shown in FIG. 1, the backrest portion 7 is locked; whereas, with the manual operating lever 10 being displaced downwardly to the position illustrated in FIG. 2, the backrest portion 7 is released so as to enable the backrest portion 7 to be displaced to a resting position.

Figure 3:
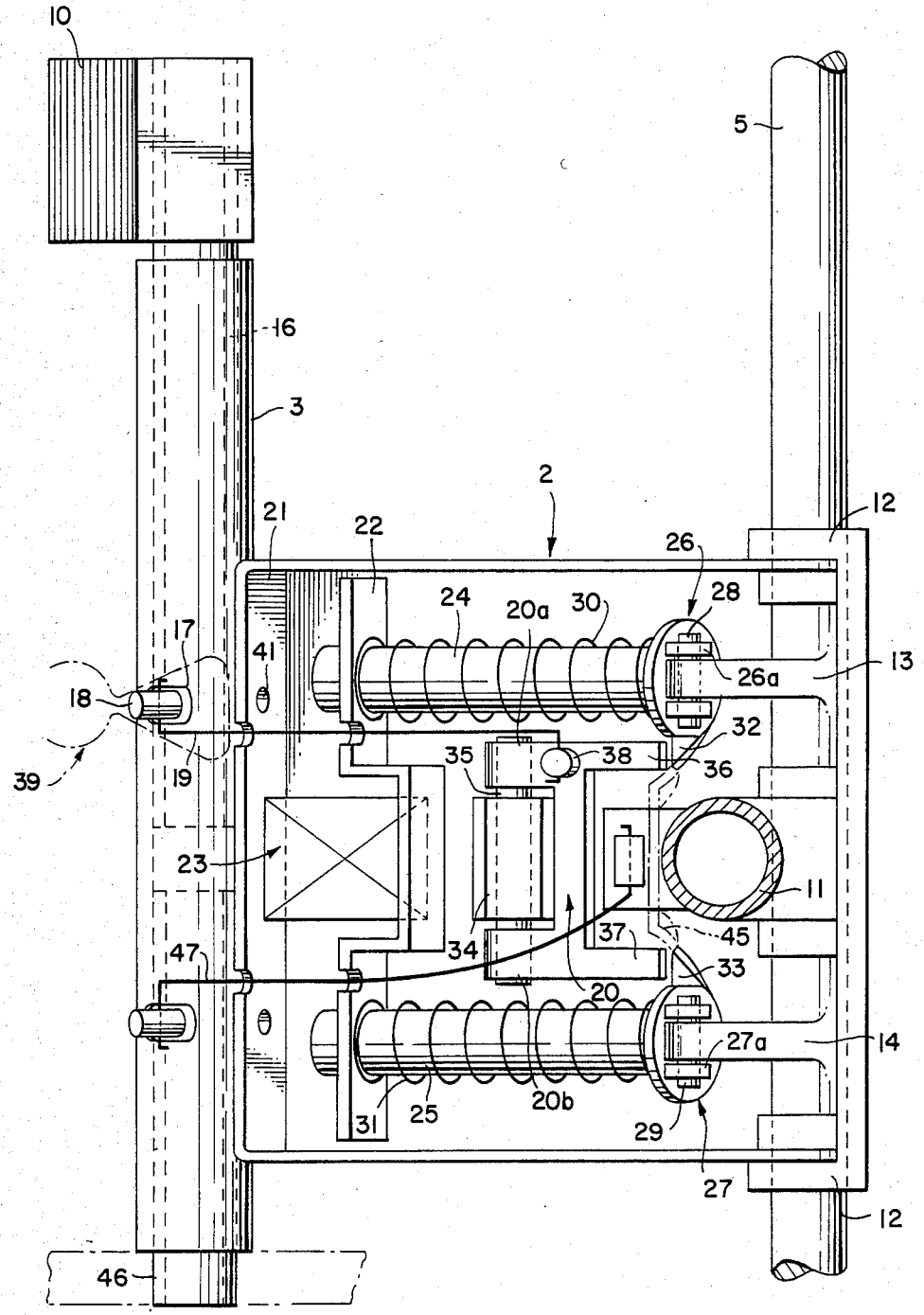
FIG. 3 is a partial lower view taken in the direction of the arrow III—III in FIG. 1 of a mechanism for locking the office chair of the present invention in the position shown in FIG. 1.
Figure 5:
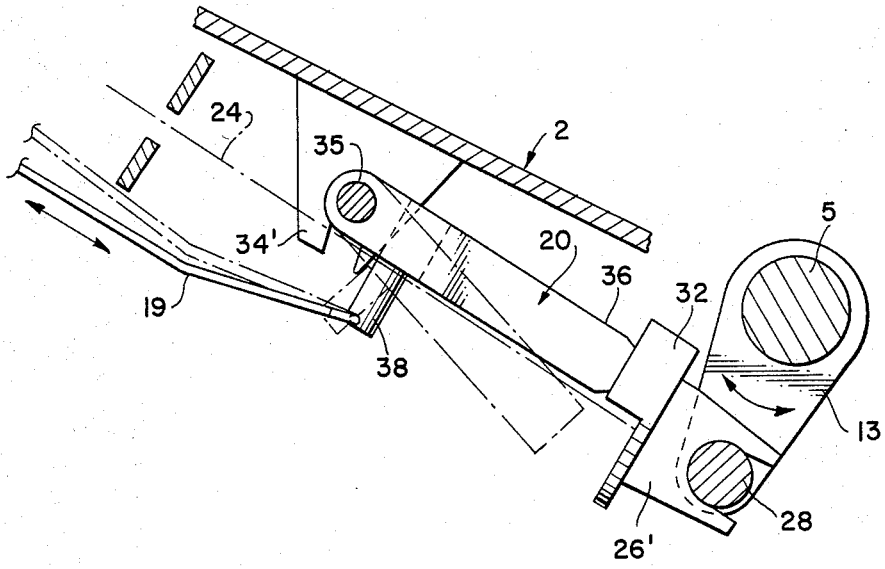
FIG. 5 is a partially schematic vertical cross sectional view through the locking mechanism of the present invention taken within the plane of the drawing of FIG. 1.
Figure 7:
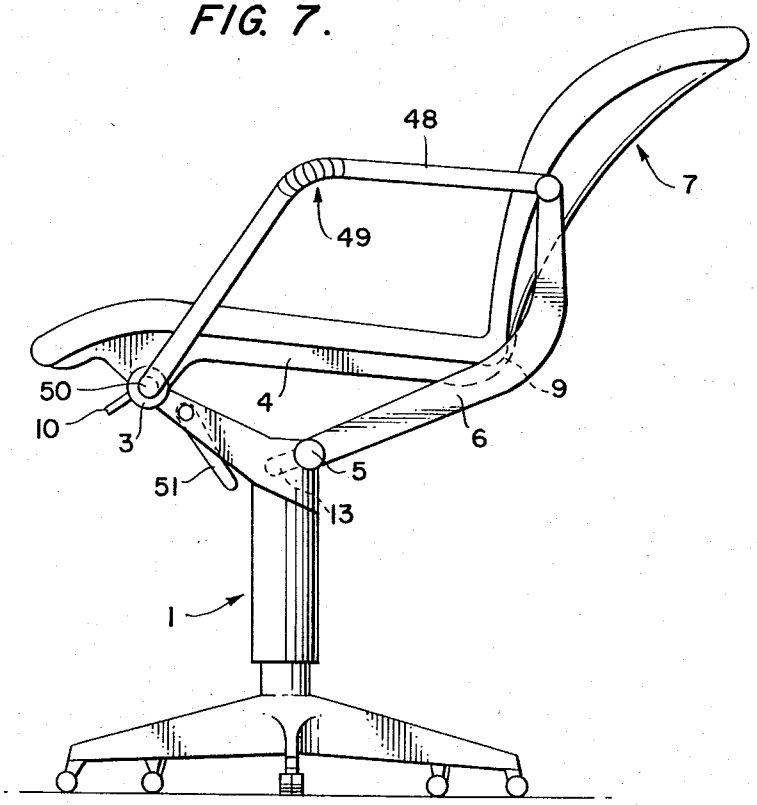
FIG. 7 is a side view of the office chair of FIG. 6 in a rearward pivoted resting position.

As shown in FIG. 3, the box-shaped housing section forming a supporting arm 2 along with the column or tubular support 11 is placed or mounted on a corresponding counter part of the column 1. Bearing means 12 are disposed at a rearward rim of the supporting arm 2 for mounting a supporting shaft 5, with the supporting shaft 5, as shown most clearly in FIGS. 3 and 5 carrying on respective sides of the tubular support or column 11 a radially downwardly extending cam 13, 14.

The bearing pipe 31 is mounted to a front wall 21 of the box-shaped housing section forming the supporting arm 2, with the operating sleeve 16 being arranged in the bearing pipe 3. The bearing pipe 3 is provided, in an area of the supporting arm 2, with a slotted hole or opening 17 extending in a peripheral direction. The slotted hole or opening 17 accommodates a pin 18 firmly joined to the operating sleeve 16. A force transmission member formed, for example, of a stiff piece of wire or cable, or the like, is connected to the pin 18. The force transmission member 19 is adapted to transmit the force or movement executed by the manual operating lever 10 to a locking lever generally designated by the reference numeral 20 of the locking mechanism. As can readily be appreciated, instead of a stiff wire piece for the force transmission member 19, a Bowden wire could also be utilized.

A partition or wall member 22 is disposed in the box-shaped housing section forming the supporting arm 2, with the partition or wall member 22 being arranged in parallel to the front wall 21 of the supporting arm 2. A spreading means generally designated by the reference numeral 23, of conventional contruction, may be provided for enabling an adjustment of the space or distance between the partition or wall member 22 and the front wall 21. The partition or wall member 22 has two control rods 24, 25 extending therethrough, with the respective control rods 24, 25 carrying at front ends thereof, a bifurcated spherical bearing means generally designated by the reference numerals 26, 27 to which the cams 13, 14 are articulated by way of suitable mounting means such as, for example, articulating pins or bolts 28, 29. The bifurcated spherical bearing means 26, 27 each include a disc **26*a*, 27*a* and a helical compression spring 30, 31 clamped in a position between the respective discs 26*a*, 27*a* and the partition or wall member 22, with the compression springs 30, 31 respectively surrounding the control rods 24, 25. By an adjustment of the spreading means 23, the bias or spring characteristics of the helical compression springs 30, 31 can be adjusted in a conventional manner. The bifurcated spherical bearing means 26, 27 further respectively include a stop member 32, 33 each having a forward facing abutment surface, that is, an abutment surface facing toward the forward bearing pipe 3**.

A bearing 34 for accommodating a bolt 35, disposed in parallel to the bearing pipe 3 and the supporting shaft 5, is provided on a bottom of the box-like housing section forming the supporting arm 2. The locking lever 20 is, in a top view, approximately H-shaped and is arranged with legs **20*a*, 20*b* mounted on the respective projecting ends of the bolt 35. Free legs of the locking lever 20 are pivotally mounted and are formed as locking arms 36, 37 arranged forwardly of the stop members 32, 33. The locking arms 36, 37 are adapted to be pivoted toward and away from the stop members 32, 33 through the force transmission member 19 upon a displacement of the manual operating lever 10. More particularly, as shown in FIG. 3, the force transmission member 19 engages a pin 38 which is disposed approximately at a right angle to the bolt 35 and is mounted to the locking lever 20 at a predetermined distance from the bolt 35. As shown most clearly in FIG. 5, the bifurcated spherical bearing means 26, 27 for the articulating pins 28, 29 of the cams 13, 14 and the bearing 34 for the bolt 35 can also each be constructed as open bearing shells 26′ 34′**, respectively.

Figure 4:
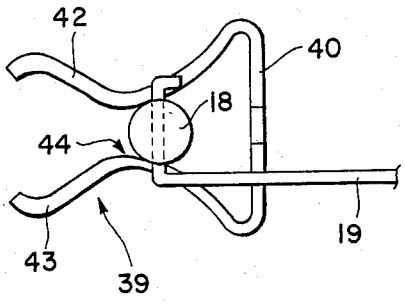
FIG. 4 is a detail view, on an enlarged scale, of a detent spring means for securing the office chair in two end positions of the locking mechanism.

In order to secure the two end positions of the operating lever and/or the entire locking mechanism, a leaf spring generally designated by the reference numeral 39 is provided which, as shown most clearly in FIG. 4, is formed into a hair pin shape. The leaf spring 39 is attached with a rear leg 40 thereof in an area of a hole or opening 41 (FIG. 3) to the partition or front wall member 21 of the supporting arm 2 so that the leaf spring 39 encompasses, with two spring legs 42, 43, the pin 18. The two legs 42, 43 are bent in close proximity to each other in a central area thereof and form a detent step generally designated by the reference numeral 44 which is adapted to apply a detent force which must be overcome by the pin 18 when the manual operating lever 10 is displaced between the two end positions.

As illustrated in phantom lines in FIG. 3, the two bifurcated spherical bearing means 26, 27 may be rigidly joined by way of a bridge 45 so as to circumvent the column of tubular support 11 thereby ensuring a symmetrical force distribution to an especially high degree and an avoidance of bending moments and canting actions.

As shown in FIG. 3, the locking mechanism may be fashioned so as to be very compact and space saving and may be accommodated in the manner so that it is possible to arrange still further devices such as, for example, the spreading means 23 or another operating sleeve 46 with a linkage 47 for enabling vertical adjustment of the seat within the box-shaped housing section forming the supporting arm 2.

Figure 6:
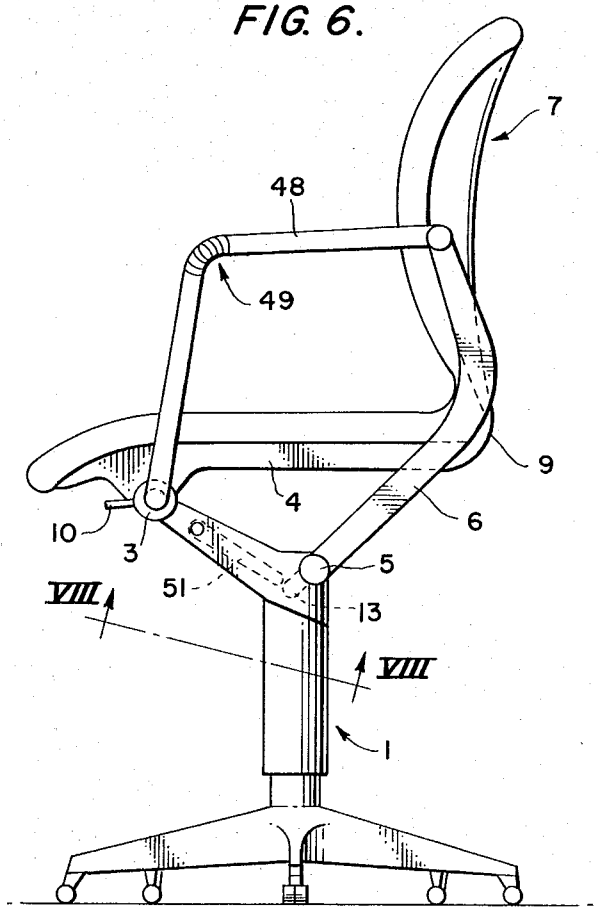
FIG. 6 is a side view of a second embodiment of a piece of sitting furniture constructed in accordance with the present invention, fashioned as an office chair, in a vertical or basic position.
Figure 8:
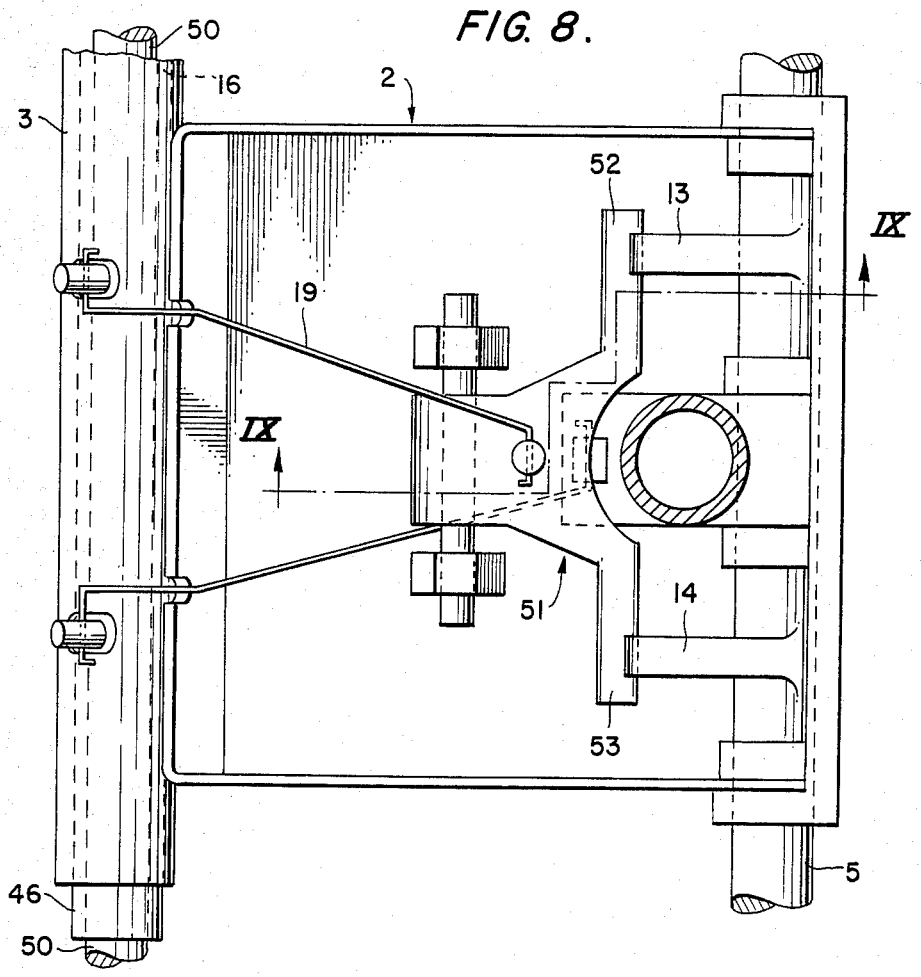
FIG. 8 is a detail view, on an enlarged scale, taken in the direction of the arrow VIII—VIII in FIG. 6.
Figure 9:
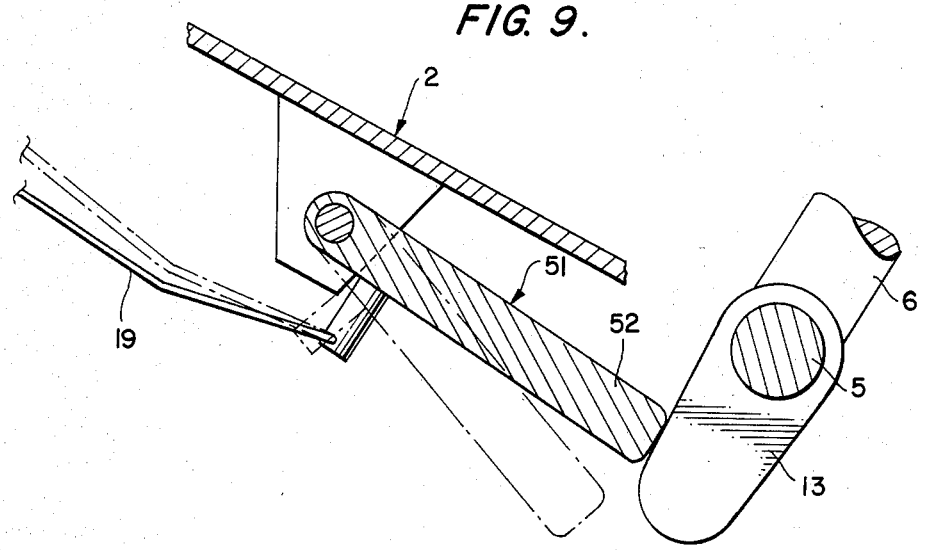
FIG. 9 is a cross sectional view taken along the line IX—IX in FIG. 8.

While, in the embodiment of FIGS. 1–5, the springs 30, 31 are adapted to stress the backrest portion 7 in the direction of a steep or vertical position and are arranged beneath or below the seat portion 4 in the housing section forming the supporting arm 2, as shown in FIGS. 6–9, angled arm rests 48 may be provided which are constructed so as to be resilient in a curved area thereof generally designated by the reference numeral 49 so as to maintain the backrest portion 7 in an unstressed condition in the upright position shown in FIG. 6.

The arm rests 48 are rigidly connected at front and lower ends thereof to a shaft 50 accommodated in and extending through the bearing pipe 3 and to the operating sleeves 16, 46 accommodated by the bearing pipe 3 thereby ensuring synchronous movement of both arm rests 48. In this arrangement, a V-shaped locking lever generally designated by the reference numeral 51 serves for locking the backrest portion 7, with the locking lever 51 being mounted to an underside of the box-like housing section forming the supporting arm 2 so as to be pivotable about the bolt 45. As with the embodiment of FIGS. 1–5, the locking lever 51 may be pivoted through a force transmission member 19 and manual operating lever 10 whereby the locking lever 51, with locking arms 52, 53 may be pivoted directly in front of the cams 13, 14.

While We have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A chair comprising a seat portion, a backrest portion flexibly joined to the seat portion, means for urging the backrest portion into a substantially vertical position, support means for supporting the seat portion and backrest portion including a front bearing means articulatingly connected to a front edge of the seat portion, a locking means for locking the backrest portion in the vertical position and at least one inclined position, lock operating lever means pivotably mounted to the support means for controlling an operation of the locking means, a lock operating sleeve means operatively connected to said locking means and extending through said front bearing means, force transmission means interposed between said lock operating sleeve means and said locking means, said locking means including catch means cooperable with said lever means for selectively locking the back rest portion in said vertical position and in said at least one inclined position upon actuation of said lock operating lever means.

2. A chair according to claim 1, wherein said support means further includes a substantially horizontally disposed support shaft means arranged beneath the seat portion at a predetermined spacing therefrom for supporting a rear area of said seat portion, and wherein at least one supporting lever means is arranged between said support shaft means and said backrest portion.

3. A chair according to claim 2, wherein one end of said at least one supporting lever means is rigidly connected to said support shaft means, and a second end of said at least one supporting lever means is pivotally connected to the backrest portion.

4. A chair according to claim 3, wherein the second end of said at least one supporting lever means is connected to the backrest portion approximately at a hip level of the chair.

5. A chair according to claim 4, wherein at least two supporting lever means are provided and are disposed on respective lateral sides of the chair.

6. A chair according to claim 3, wherein said catch means includes a locking lever means pivotally mounted to said supporting means and operatively connected to the force transmission means, and at least one cam means cooperable with said locking lever means and disposed on said support shaft means.

7. A chair according to claim 6, wherein said support means further includes a housing means forming an underframe of the chair, the locking lever means is mounted on said housing means and includes at least one locking arm means cooperable with said at least one cam means, said housing means includes a column-like support portion extending in a direction of a base of the chair, said at least one locking arm means being disposed to one lateral side of said column-like support portion.

8. A chair according to claim 6, wherein said support means includes a housing means forming an underframe of the chair, the locking lever means is mounted on said housing means and includes at least two locking arm means, said housing means includes a column-like support portion, said at least two locking arm means are disposed on respective lateral sides of said column-like support portion so as to encompass said support portion therebetween, and wherein at least two cam means are disposed on said support shaft means, said at least two locking lever means being disposed so as to respectively cooperate with said at least two cam means.

9. A chair according to claim 8, wherein said force transmission means includes a pin means provided on said lock operating sleeve means, said bearing means includes a pipe-shaped member having a slotted opening on a periphery thereof for displacably accommodating said pin means, said pin means extending radially outwardly from said lock operating sleeve means and being connected to said force transmission means.

10. A chair according to claim 9, wherein said force transmission means includes a wire means.

11. A chair according to claim 9, wherein said force transmission means includes a Bowden cable means.

12. A chair according to claim 9, wherein detent means are provided for defining two end positions of said pin means.

13. A chair according to claim 12, wherein said detent means includes a spring means having a leg portion thereof attached to said housing means, and a step portion defining a detent area.

14. A chair according to claim 13, wherein said spring means has an approximately hairpin configuration and said leg portion forms a rear portion of said spring means.

15. A chair according to claim 14, wherein said means for urging said backrest portion into a substantially vertical position includes at least two control rod means, a pair of compression springs respectively surrounding said control rod means, means for respectively connecting said control rod means to said cam means, and means for mounting said means for connecting so as to ensure a symmetrical distribution of forces.

16. A chair according to claim 15, wherein said means for connecting includes a bifurcated spherical bearing means, and wherein said means for mounting includes a bridge means disposed on a base side of the chair for circumventing said column-like support portion.

17. A chair according to claim 16, wherein said pair of control rod means are disposed substantially in parallel to each other, said cam means are arranged so as to project downwardly from said support shaft, and said spherical bearing means articulatingly connect the respective control rod means to said cam means.

18. A chair according to claim 1, further comprising at least one arm means mounted on a lateral side of the chair, and wherein said means for urging said backrest portion into a substantially vertical position includes a resilient portion provided in said at least one arm means.

19. A chair according to claim 2, wherein said catch means includes a locking lever means pivotally mounted to said support means and operatively connected to said force transmission means, and at least one cam means cooperable with said locking lever means and disposed on said support shaft means.

20. A chair according to claim 19, wherein at least two cam means are mounted on said support shaft means, said locking lever means being adapted to cooperate with each of said cam means.

21. A chair according to claim 1, wherein means are mounted on said support means for enabling a height adjustment of said backrest portion.

22. A chair according to claim 1, wherein said catch means includes a locking lever means pivotally mounted to said support means, said locking lever means includes a pair of locking arms, a pair of cam means mounted on said support means for respectively cooperating with said locking lever means to enable a locking and unlocking of the chair, and means for mounting said cam means to said support.

23. A chair according to claim 22, wherein said cam means are mounted at respective ends of a support shaft means disposed substantially in parallel to said front bearing means, means for enabling an adjustment of a force applied by said means for urging, and means for connecting said means for enabling to said cam means.

24. A chair according to claim 23, wherein said means for urging includes a pair of control rod means interposed between a wall member of said support means and said cam means, and spring means surrounding respective control rod means, and wherein said means for connecting said means for enabling includes a spherical bearing means for respectively connecting said control rod means to said cam means.

* * * * *

UNITED STATES PATENT AND TRADEMARK OFFICE

CERTIFICATE OF CORRECTION

PATENT NO. : 4,509,793

DATED : April 9, 1985

INVENTOR(S) : Herbert L. WIESMANN, ET AL.

It is certified that error appears in the above-identified patent and that said Letters Patent is hereby corrected as shown below:

On the title page; assignee should read:

(73) Assignee: Wilkhahn Wilkening Hahne GmbH & Co.--

Signed and Sealed this

*Eighth* Day of *October 1985*

[SEAL]

*Attest:*

DONALD J. QUIGG

*Attesting Officer*

*Commissioner of Patents and Trademarks—Designate*